US009982910B2

(12) United States Patent
Perry et al.

(10) Patent No.: US 9,982,910 B2
(45) Date of Patent: May 29, 2018

(54) INTERNAL TANK HEATING COIL

(71) Applicant: QMAX CATALYTIC, LLC, Golden, CO (US)

(72) Inventors: Thomas William Perry, Charlotte, NC (US); Christopher Michael Klein, Golden, CO (US); Carson Hannah, Charlotte, NC (US)

(73) Assignee: QMAX CATALYTIC, LLC, Golden, CO (US)

( * ) Notice: Subject to any disclaimer, the term of this patent is extended or adjusted under 35 U.S.C. 154(b) by 165 days.

(21) Appl. No.: 15/148,418

(22) Filed: May 6, 2016

(65) Prior Publication Data

US 2016/0327309 A1 Nov. 10, 2016

Related U.S. Application Data

(60) Provisional application No. 62/158,116, filed on May 7, 2015.

(51) Int. Cl.

| | |
|---|---|
| ***F24H 1/00*** | (2006.01) |
| ***F23D 14/18*** | (2006.01) |
| ***F23C 3/00*** | (2006.01) |
| ***F23C 13/00*** | (2006.01) |

(52) U.S. Cl.

CPC ..... *F24H 1/0045* (2013.01); *F23C 3/002* (2013.01); *F23C 3/004* (2013.01); *F23C 13/00* (2013.01); *F23D 14/18* (2013.01)

(58) Field of Classification Search

CPC ..... F23L 11/005; F23M 2900/11021; F23N 5/24; F24H 9/2035; F24H 1/202; F24H 1/20; F24H 1/207; F24H 1/186; F24H 1/0045; H05B 3/48; H05B 3/44; F23D 14/18

USPC ..... 122/4 A, 18.31, 13.01, 14.1, 14.2, 17.1, 122/4 D; 392/441, 455, 457; 219/202, 219/260, 213, 267, 270

See application file for complete search history.

(56) References Cited

U.S. PATENT DOCUMENTS

| | | | | |
|---|---|---|---|---|
| 4,886,017 | A * | 12/1989 | Viani | F23C 13/00 110/345 |
| 2002/0124575 | A1* | 9/2002 | Pant | F17C 9/02 62/50.1 |
| 2003/0031971 | A1* | 2/2003 | Sugimoto | F23C 13/00 431/268 |
| 2005/0155784 | A1* | 7/2005 | Perkins | H01H 13/183 174/66 |
| 2011/0311928 | A1* | 12/2011 | Zimmer | F17C 7/04 432/9 |

(Continued)

*Primary Examiner* — Helena Kosanovic
*Assistant Examiner* — Ko-Wei Lin
(74) *Attorney, Agent, or Firm* — Chad Tillman; Jeremy Doerre; Tillman Wright, PLLC

(57) ABSTRACT

A system includes a tank containing a fluid to be heated; a U-shaped pipe disposed proximate a bottom of the tank, a majority of the extent of the U-shaped pipe being disposed within an interior of the tank; a catalyst unit embedded within the U-shaped pipe, the catalyst unit comprising a catalyst wrapped, natural gas filled, perforated pipe that is configured to enable a catalytic reaction on its exterior; a vent pipe attached to the U-bend pipe which allows air to circulate; and mechanical controls disposed proximate the U-shaped pipe configured to vary temperature output.

20 Claims, 14 Drawing Sheets

(56) References Cited

U.S. PATENT DOCUMENTS

| | | | | |
|---|---|---|---|---|
| 2012/0090560 | A1* | 4/2012 | Iwama | F24H 1/145 122/14.3 |
| 2013/0207422 | A1* | 8/2013 | Potton | B60N 2/5685 297/180.12 |
| 2014/0224191 | A1* | 8/2014 | Thiessen | B65D 88/744 122/18.3 |
| 2014/0245972 | A1* | 9/2014 | Thiessen | B65D 88/744 122/18.3 |

* cited by examiner

INTERNAL TANK HEATING COIL

CROSS-REFERENCE TO RELATED APPLICATION

The present application is a U.S. nonprovisional patent application of, and claims priority under 35 U.S.C. § 119(e) to, U.S. provisional patent application 62/158,116, filed May 7, 2015, which provisional patent application is incorporated by reference herein.

The present application hereby incorporates herein by reference the entire disclosure of Exhibit 1 attached hereto.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to tank heating.

Natural gas wells generally have storage tanks that are used to hold oil, water, and other production fluids after they are extracted from the ground. In cold climates, or where the fluids are waxy, the tanks require supplemental heat to ensure the products do not freeze and are kept in a liquid state. Conventionally, the primary method for heating these tanks is direct-fired gas heaters which blow burning gas into a tank within a contained pipe. The gas is burned, creating heat which then heats the product inside the tank. The waste heat from this burner is sent into a stack which carries the wasted energy and combustion byproducts to the top of the tank and into the atmosphere.

A need exists for improvement in tank heating. This need and other needs are addressed by one or more aspects of the present invention.

SUMMARY OF THE INVENTION

The present invention includes many aspects and features. Moreover, while many aspects and features relate to, and are described in, a particular context, the present invention is not limited to use only in this context, as will become apparent from the following summaries and detailed descriptions of aspects, features, and one or more embodiments of the present invention.

Accordingly, one aspect of the present invention relates to a system for heating a vessel comprising a U-shaped pipe disposed proximate a bottom of a vessel, a majority of the extent of the U-shaped pipe being disposed within an interior of the vessel; a catalyst unit embedded within the U-shaped pipe, the catalyst unit comprising a catalyst wrapped, natural gas filled, perforated pipe that is configured to enable a catalytic reaction on its exterior; a vent pipe attached to the U-bend pipe which allows air to circulate; and mechanical controls disposed proximate the U-shaped pipe configured to vary temperature output.

Another aspect relates to a system for heating a vessel comprising a tank containing a fluid to be heated; a U-shaped pipe disposed proximate a bottom of the tank, a majority of the extent of the U-shaped pipe being disposed within an interior of the tank; a catalyst unit embedded within the U-shaped pipe, the catalyst unit comprising a catalyst wrapped, natural gas filled, perforated pipe that is configured to enable a catalytic reaction on its exterior; a vent pipe attached to the U-bend pipe which allows air to circulate; and mechanical controls disposed proximate the U-shaped pipe configured to vary temperature output.

Another aspect relates to a method for heating a vessel comprising starting a catalytic reaction using a catalyst unit embedded within a U-shaped pipe, the U-shaped pipe being disposed proximate a bottom of a vessel, a majority of the extent of the U-shaped pipe being disposed within an interior of the vessel, the catalyst unit comprising a catalyst wrapped, natural gas filled, perforated pipe that is configured to enable a catalytic reaction on its exterior; varying a temperature output based on the catalytic reaction using one or more mechanical controls disposed proximate the U-shaped pipe.

Another aspect relates to a system for heating a vessel comprising a tank containing a fluid to be heated; an outer shell comprising a tubular upper leg, a tubular lower leg disposed generally parallel to the tubular upper leg, wherein the tubular lower leg is in fluid connection with the tubular upper leg proximate a first end of the tubular lower leg, wherein the tubular lower leg comprises an access opening at a second end of the tubular lower leg providing access to an interior thereto; a catalyst insert disposed within the interior of the tubular lower leg, the catalyst insert comprising a central gas delivery tube comprising a plurality of openings disposed along its length for the outflow of gas from the gas delivery tube, a generally cylindrical perforated core surrounding the central gas delivery tube, the perforated core comprising a plurality of openings for facilitating flow of gas through the perforated core, refractory insulation wrapped around the outside of the perforated core, a heating element comprising a wire including a non-insulated segment of wire coiled around the outside of the refractory insulation generally down the entire length of the catalyst insert, and an insulated segment of wire running generally back up along the entire length of the catalyst insert, a catalyst element wrapped around the refractory insulation such that the coiled wire is disposed between the refractory insulation and the catalyst element, the catalyst element being configured to facilitate a catalytic reaction, front and end caps configured to secure components of the catalyst insert, the front cap comprising an opening for the central gas delivery tube, and an opening for one or more electrical connectors for the heating element; a vent apparatus connected to the tubular upper leg for venting gas byproducts of the catalytic reaction facilitated by the catalyst element; a temperature sensor configured to monitor a temperature proximate the catalyst element; a cover configured to generally cover the access opening of the tubular lower leg, the cover comprising a gas line opening having a gas line passing therethrough that is connected to the central gas delivery tube of the catalyst insert, a sensor opening having a connecting wire for the temperature sensor passing therethrough, one or more electrical openings having one or more electrical connectors for the heating element of the catalyst insert passing therethrough, one or more airflow openings configured to provide air to sustain a catalytic reaction; an automatic shutoff valve configured to cease the flow of gas through the gas line based on the temperature sensor if a temperature drops below a first predetermined threshold; an initiation button configured to initiate a pre-heating process comprising providing power to the heating element, automatically, based on a determination by the temperature sensor that a temperature proximate the catalyst element exceeds a second predetermined threshold, terminating the provision of power to the heating element, and opening the automatic shutoff valve allowing for the flow of gas through the gas line.

In a feature of this aspect, the gas line provides natural gas.

In a feature of this aspect, the temperature sensor comprises a thermocouple.

In a feature of this aspect, the catalyst element is configured to facilitate a catalytic reaction utilizing air and natural gas which generates byproducts of water, carbon dioxide, and heat.

In a feature of this aspect, the catalyst element comprises an alumina-silica pad washed with elemental platinum to act as a hydrocarbon catalyst.

In a feature of this aspect, the refractory insulation comprises an alumina-silica pad.

In a feature of this aspect, the first and second predetermined thresholds are the same.

In a feature of this aspect, the temperature sensor is a mechanical sensor.

In a feature of this aspect, the temperature sensor is a digital sensor.

In a feature of this aspect, the first and second predetermined thresholds are different.

In a feature of this aspect, the first predetermined threshold is around three hundred degrees Fahrenheit.

Another aspect relates to a method for heating a vessel, the method involving a tank containing a fluid to be heated; an outer shell comprising a tubular upper leg, a tubular lower leg disposed generally parallel to the tubular upper leg, wherein the tubular lower leg is in fluid connection with the tubular upper leg proximate a first end of the tubular lower leg, wherein the tubular lower leg comprises an access opening at a second end of the tubular lower leg providing access to an interior thereto; a catalyst insert disposed within the interior of the tubular lower leg, the catalyst insert comprising a central gas delivery tube comprising a plurality of openings disposed along its length for the outflow of gas from the gas delivery tube, a generally cylindrical perforated core surrounding the central gas delivery tube, the perforated core comprising a plurality of openings for facilitating flow of gas through the perforated core, refractory insulation wrapped around the outside of the perforated core, a heating element comprising a wire including a non-insulated segment of wire coiled around the outside of the refractory insulation generally down the entire length of the catalyst insert, and an insulated segment of wire running generally back up along the entire length of the catalyst insert, a catalyst element wrapped around the refractory insulation such that the coiled wire is disposed between the refractory insulation and the catalyst element, the catalyst element being configured to facilitate a catalytic reaction, front and end caps configured to secure components of the catalyst insert, the front cap comprising an opening for the central gas delivery tube, and an opening for one or more electrical connectors for the heating element; a vent apparatus connected to the tubular upper leg for venting gas byproducts of the catalytic reaction facilitated by the catalyst element; a temperature sensor configured to monitor a temperature proximate the catalyst element; a cover configured to generally cover the access opening of the tubular lower leg, the cover comprising a gas line opening having a gas line passing therethrough that is connected to the central gas delivery tube of the catalyst insert, a sensor opening having a connecting wire for the temperature sensor passing therethrough, one or more electrical openings having one or more electrical connectors for the heating element of the catalyst insert passing therethrough, one or more airflow openings configured to provide air to sustain a catalytic reaction; an automatic shutoff valve configured to cease the flow of gas through the gas line based on the temperature sensor if a temperature drops below a first predetermined threshold; and an initiation button configured to initiate a pre-heating process; wherein the method comprises, in response to pressing of the initiation button by a user, providing power to the heating element, automatically, based on a determination by the temperature sensor that a temperature proximate the catalyst element exceeds a second predetermined threshold, terminating the provision of power to the heating element, and opening the automatic shutoff valve allowing for the flow of gas through the gas line.

Another aspect relates to a method for heating a vessel, the method involving a tank containing a fluid to be heated; an outer shell comprising a tubular upper leg, a tubular lower leg disposed generally parallel to the tubular upper leg, wherein the tubular lower leg is in fluid connection with the tubular upper leg proximate a first end of the tubular lower leg, wherein the tubular lower leg comprises an access opening at a second end of the tubular lower leg providing access to an interior thereto; a catalyst insert disposed within the interior of the tubular lower leg, the catalyst insert comprising a central gas delivery tube comprising a plurality of openings disposed along its length for the outflow of gas from the gas delivery tube, a generally cylindrical perforated core surrounding the central gas delivery tube, the perforated core comprising a plurality of openings for facilitating flow of gas through the perforated core, refractory insulation wrapped around the outside of the perforated core, a heating element comprising a wire including a non-insulated segment of wire coiled around the outside of the refractory insulation generally down the entire length of the catalyst insert, and an insulated segment of wire running generally back up along the entire length of the catalyst insert, a catalyst element wrapped around the refractory insulation such that the coiled wire is disposed between the refractory insulation and the catalyst element, the catalyst element being configured to facilitate a catalytic reaction, front and end caps configured to secure components of the catalyst insert, the front cap comprising an opening for the central gas delivery tube, and an opening for one or more electrical connectors for the heating element; a vent apparatus connected to the tubular upper leg for venting gas byproducts of the catalytic reaction facilitated by the catalyst element; a temperature sensor configured to monitor a temperature proximate the catalyst element; a cover configured to generally cover the access opening of the tubular lower leg, the cover comprising a gas line opening having a gas line passing therethrough that is connected to the central gas delivery tube of the catalyst insert, a sensor opening having a connecting wire for the temperature sensor passing therethrough, one or more electrical openings having one or more electrical connectors for the heating element of the catalyst insert passing therethrough, one or more airflow openings configured to provide air to sustain a catalytic reaction; an automatic shutoff valve; wherein the method comprises, when gas is flowing through the gas line to the gas delivery tube of the catalyst insert, in response to a determination by the temperature sensor that a temperature proximate the catalyst element has dropped below a first predetermined threshold, automatically closing the automatic shutoff valve to stop flow of the gas to the gas delivery tube of the catalyst element.

In addition to the aforementioned aspects and features of the present invention, it should be noted that the present invention further encompasses the various possible combinations and subcombinations of such aspects and features. Thus, for example, any aspect may be combined with an aforementioned feature in accordance with the present invention without requiring any other aspect or feature.

BRIEF DESCRIPTION OF THE DRAWINGS

One or more preferred embodiments of the present invention now will be described in detail with reference to the accompanying drawings, wherein the same elements are referred to with the same reference numerals, and wherein.

DETAILED DESCRIPTION

Figure 1:
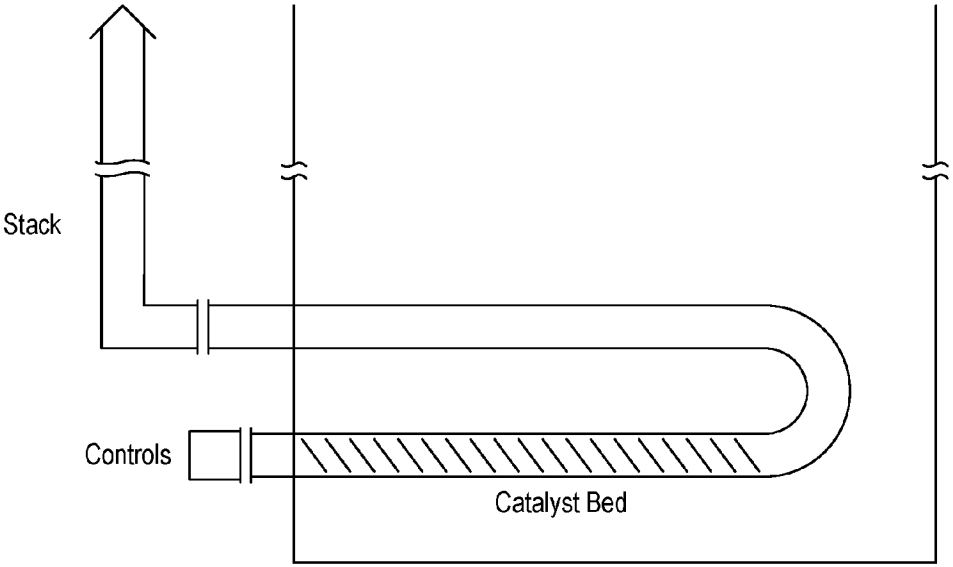
FIG. 1 illustrates a system in accordance with one or more preferred implementations.

As a preliminary matter, it will readily be understood by one having ordinary skill in the relevant art ("Ordinary Artisan") that the present invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention in any claim of a patent issuing here from, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. 112, paragraph 6 or subsection (f), no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

In accordance with one or more preferred implementations, an internal tank heating coil uses a catalytic reaction as a heat source, e.g. a catalytic reaction which produces byproducts of heat, carbon dioxide, and water. Preferably, the catalytic reaction is very efficient (e.g. more gas is consumed in full than would occur in a simple direct-fired heater) and the byproduct results in far less smog causing emissions into the atmosphere.

In accordance with one or more preferred implementations, an internal tank heating coil includes a ten foot long, catalyst wrapped, natural gas filled, perforated pipe that is configured to enable a catalytic reaction on its exterior. This unit is embedded in a larger pipe that is constructed in a U-bend shape and runs along the bottom of a vessel, as illustrated in FIG. 1. Preferably, a vent pipe is attached to the U-bend pipe allowing air to circulate through the system sustaining the catalytic reaction.

Preferably, once the catalytic reaction begins (e.g. by heating the catalyst to above 300 degrees Fahrenheit), the reaction is self-sustaining as long as air and natural gas are supplied. Preferably, the reaction can last for years before replacement or maintenance. In one or more preferred implementations, simple mechanical controls are set up to vary temperature output.

Figure 2:
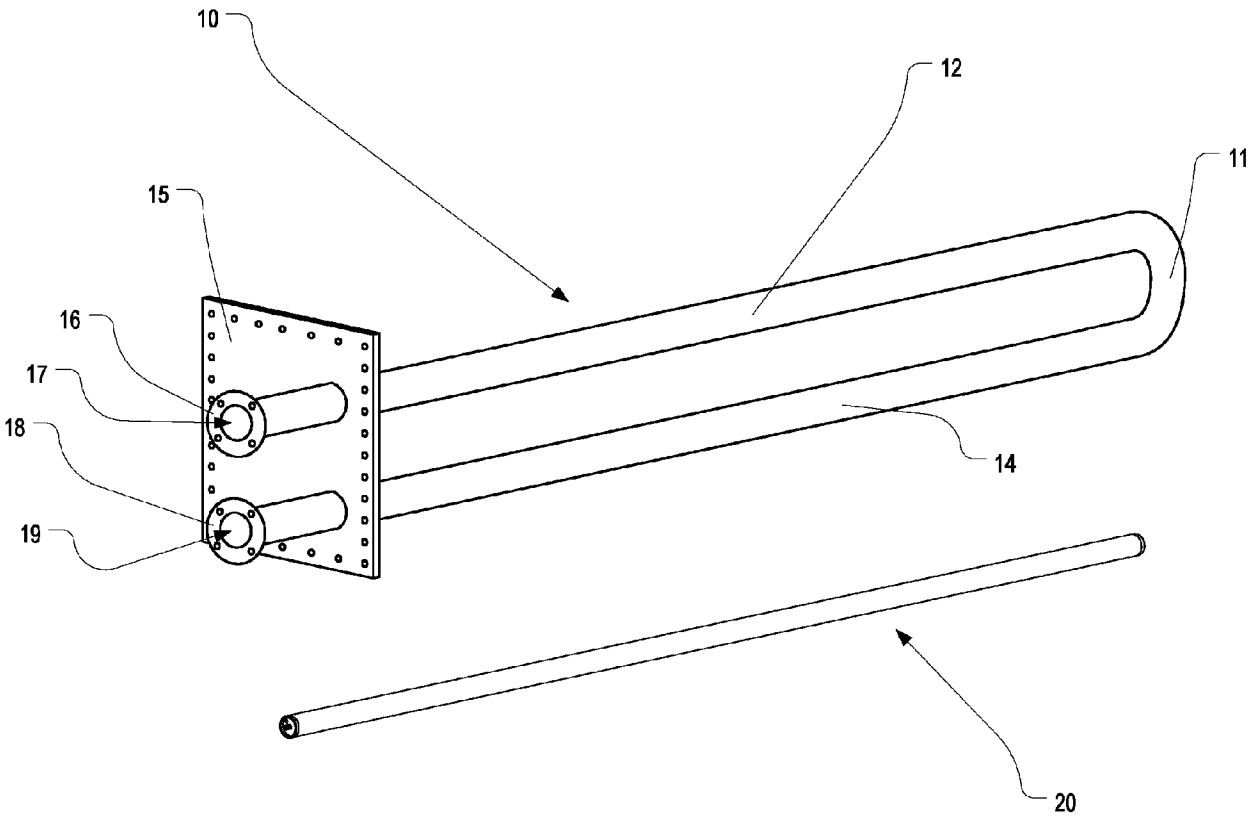
FIG. 2 is a schematic illustration of exemplary components of a system in accordance with one or more preferred implementations.

FIG. 2 is a schematic illustration of exemplary components of a system in accordance with one or more preferred implementations. These components include a generally u-shaped outer shell 10, and a catalyst insert 20. The u-shaped outer shell 10 comprises an upper tubular leg 12 and a lower tubular leg 14 connected together at one end by a curved elbow 11.

The upper and lower tubular legs 12,14 pass through, and are welded to, a manway cover 15. The manway cover 15 is preferably an American Petroleum Institute (API) standard manway cover. The u-shaped outer shell 10 can be installed in the side of a tank by passing the elbow 11 and the majority of the legs 12,14 through an appropriately sized opening in the tank and bolting the manway cover 15 to the exterior of the tank, thereby sealing the opening of the tank.

In accordance with one or more preferred implementations, each of the legs 12,14 includes a respective slip on flange 16,18 which provides access to a respective opening 17,19 into the respective leg 12,14. Although one or more implementations are described herein as using a particular type of mechanical connector or connection, it will be appreciated that, in general, various different types of connections and connectors may be utilized in various implementations.

Figure 3:
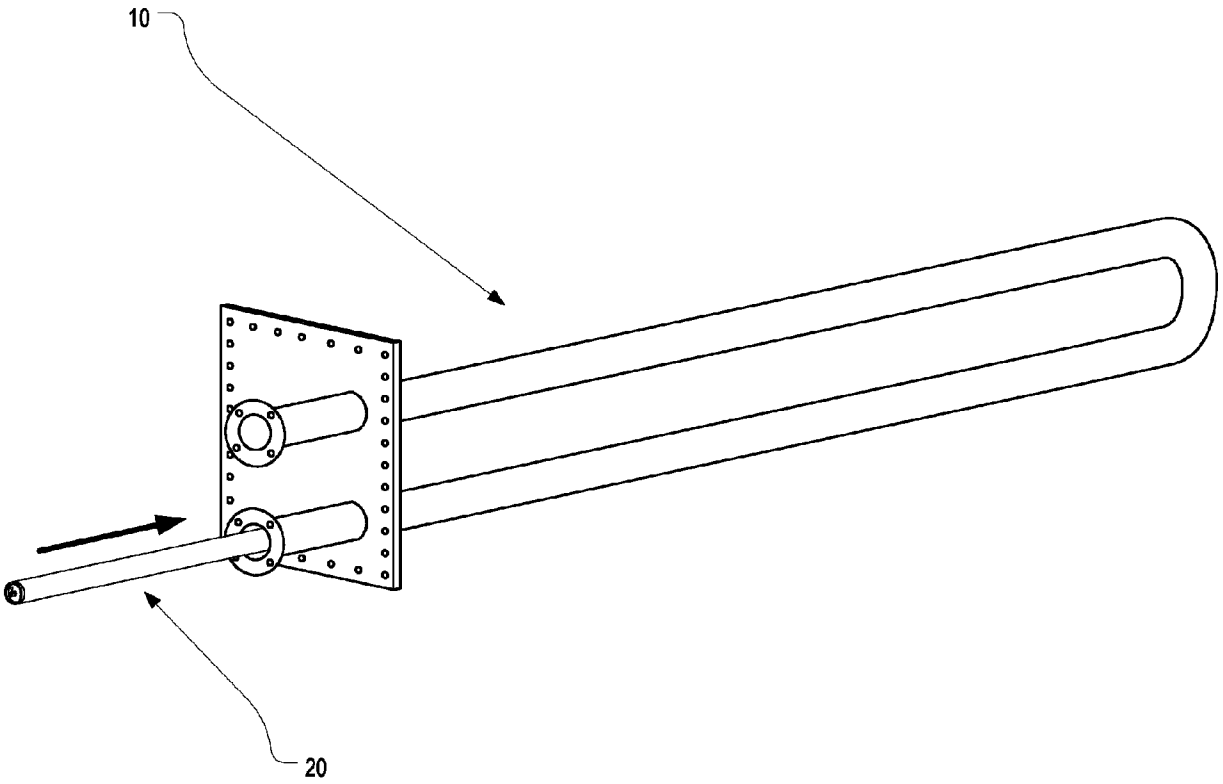
FIGS. 3-4 illustrates insertion of a catalyst insert into an outer shell.
Figure 4:
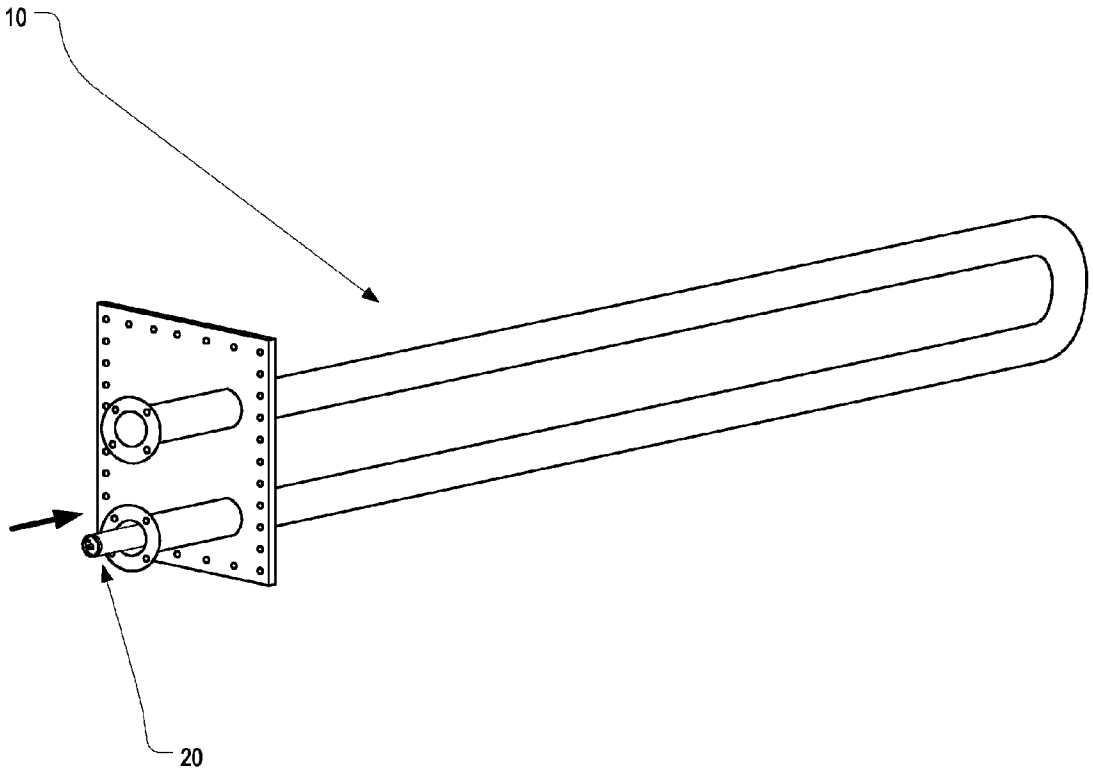

The u-shaped outer shell 10 and the catalyst insert 20 are generally sized and dimensioned to allow the catalyst insert 20 to be inserted into and received within the lower leg 14 of the outer shell 10, as illustrated in FIGS. 3-4. In accordance with one or more preferred implementations, each leg 12,14 of the outer shell 10 generally is comprised of four inch schedule A40 pipe, and the catalyst insert generally has a diameter of between two inches and three and three fourth inches. In accordance with one or more preferred implementations, a catalyst insert has a diameter generally corresponding to two inch schedule A40 pipe.

Figure 5:
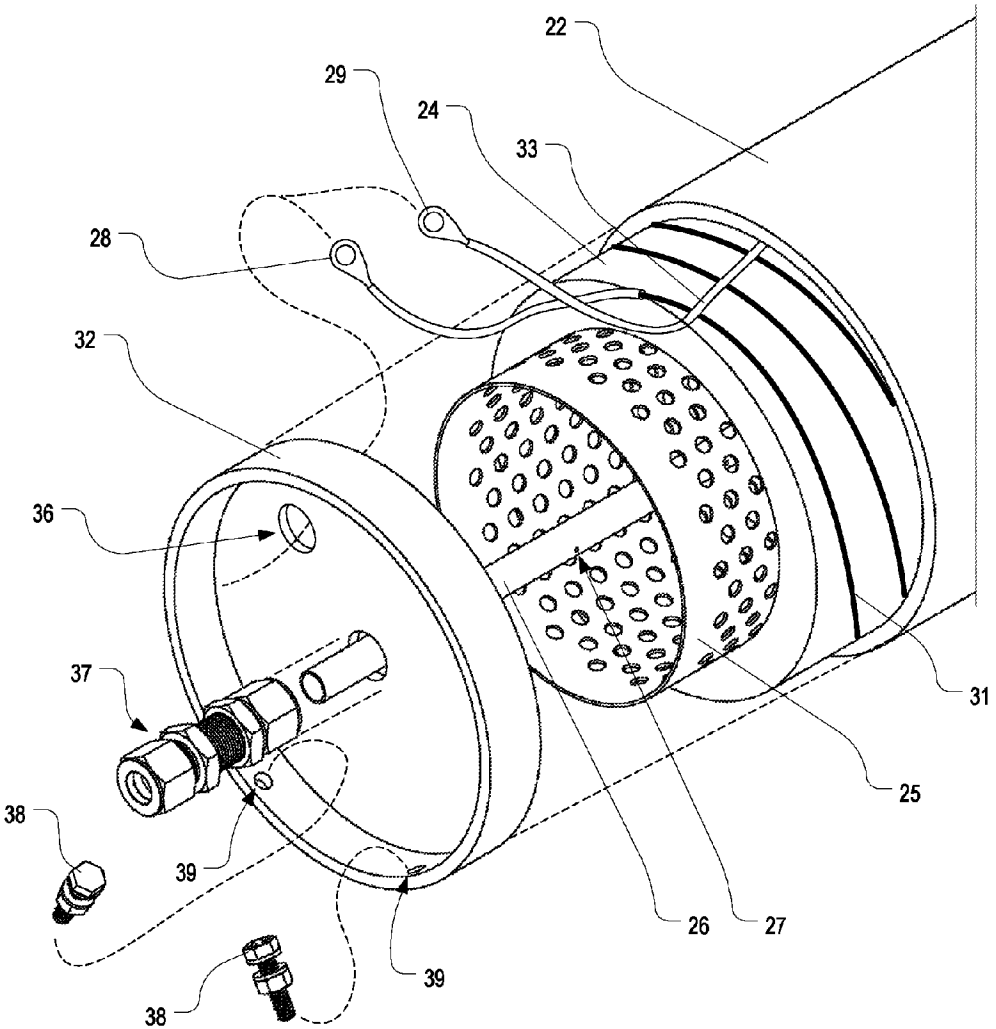
FIG. 5 is a partial, exploded view of one end of a catalyst insert.
Figure 6:
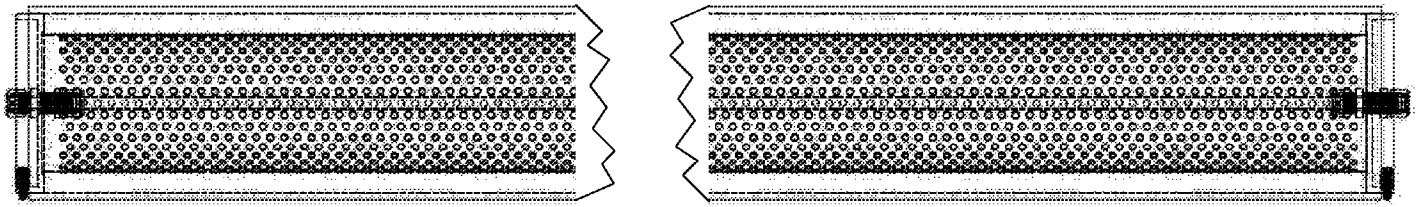
FIG. 6 is a partial, schematic illustration of a catalyst insert.

FIG. 5 is a partial, exploded view of one end of the catalyst insert 20, and FIG. 6 is a partial, schematic illustration of the catalyst insert 20.

The catalyst insert 20 includes a gas delivery tube 26 running down its center. The gas delivery tube 26 includes a plurality of holes 27 configured to allow outflow of natural gas running through the gas delivery tube 26.

The catalyst insert 20 further comprises a perforated core 25 which includes a plurality of perforation openings facilitating the flow of natural gas. In accordance with one or more preferred implementations, the perforated core 25 comprises metal configured to withstand temperatures of up to 900 degrees Fahrenheit.

The catalyst insert 20 further includes refractory insulation 24 wrapped around the outside of the perforated core 25. The refractory insulation preferably comprises a three fourths inch thick alumina-silica refractory pad.

The catalyst insert 20 further includes a catalyst element 22 wrapped around the outside of the refractory insulation 24. The catalyst element 22 comprises a one fourth inch thick alumina-silica pad washed with elemental platinum to act as a hydrocarbon catalyst.

The catalyst insert 20 further includes a heating element disposed between the refractory insulation 24 and the catalyst element 22. The heating element comprises exposed nickel chromium wire coiled around the outside of the refractory insulation 24 down the length of the catalyst insert 20. Although this coiled wire segment 31 is uninsulated, a second length of the wire (or a second, connected wire) that returns back up the length of the catalyst insert 20 is insulated and represents an insulated return wire segment 33. Each end of the chromium wire is configured for connection to a power source to form a complete circuit and cause the exposed length of the chromium wire to act as a resistive heat source.

To initiate operation, power is supplied causing the nickel chromium wire to act as a resistive heat source. Once the catalyst element 22 reaches three hundred degrees Fahrenheit, natural gas is introduced via the gas delivery tube 26 and a self-sustaining catalytic reaction takes place. At this point, power can be cut to the chromium wire, as it is no longer needed to sustain the reaction. In accordance with one or more preferred implementations, a 12 VDC source (such as a car battery) is utilized as a power source. Amperage at 12 VDC for a 20 k BTU unit is around 13 amps, and it generally will take around seven to ten minutes to heat the catalyst to an appropriate temperature.

The catalytic reaction is flameless, requires only air and natural gas to sustain, and creates byproducts in the form of water, carbon dioxide, and radiative heat. In operation, the water (in the form of steam) and carbon dioxide flow through the elbow 11 and upper leg 12 of the outer shell 10, and out through a stack or other venting mechanism. Preferably, there are no NOx or SOx byproducts, as the reaction takes place below the temperature at which these form. In accordance with one or more preferred implementations, the maximum temperature of the reaction is around nine hundred degrees Fahrenheit.

The catalyst insert 20 further includes a front cap 32 configured to secure the components of the catalyst insert 20 generally in place. The front cap 32 includes an opening for the gas delivery tube 26, as well as an opening 36 for ends of or one or more electrical connectors 28,29 for the nickel chromium wire. The catalyst insert 20 further includes an end cap, which may in one or more preferred implementations may be identical to the front cap, or may omit one or more openings (e.g. an opening for the gas delivery tube 26).

The catalyst insert 20 further includes a tube bulkhead 37 for the gas delivery tube 26 configured to facilitate securement of the front cap 32 and connection of a gas line to the gas delivery tube 26.

The front cap 32 includes stand-off openings 39 for insertion and securement of stand-off bolts 38. The stand-off bolts 38 facilitate proper positioning and/or orientation of the catalyst insert 20 within the lower leg 14 of the outer shell 10.

Figure 7:
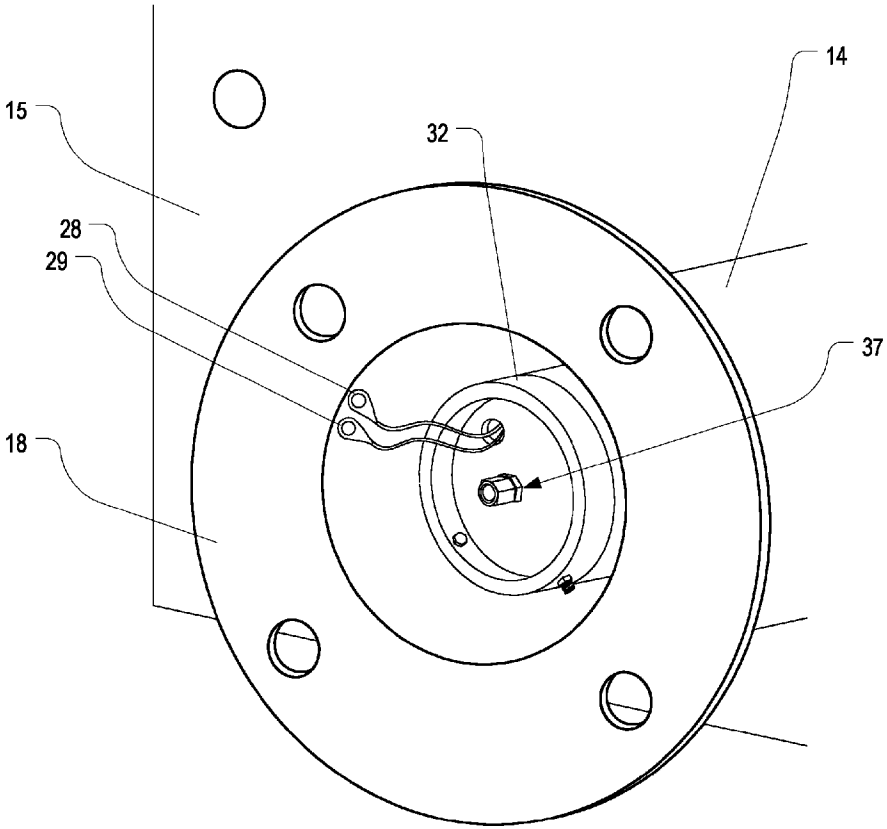
FIG. 7 is a close up, partial view of a catalyst insert received within a lower leg of an outer shell.

FIG. 7 is a close up, partial view of the catalyst insert 20 received within the lower leg 14 of the outer shell 10.

In accordance with one or more preferred implementations, a cover such as a blind flange is utilized to generally cover the opening of the lower leg 14 of the outer shell 10 with the catalyst insert 20 received therein.

Figure 8:
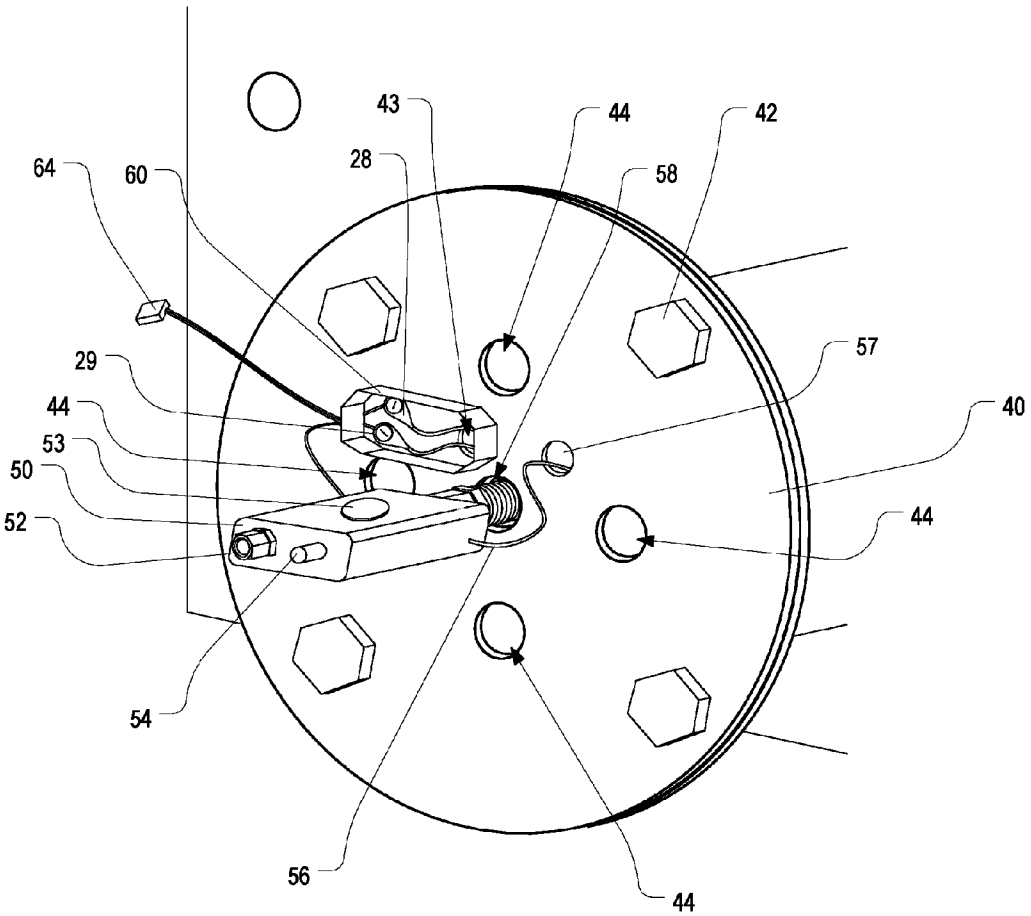
FIG. 8 depicts a fanciful, simplified exemplary cover which illustrates features that may be part of a cover in accordance with one or more preferred implementations.

FIG. 8 depicts a fanciful, simplified exemplary cover 40 which illustrates features that may be part of a cover in accordance with one or more preferred implementations.

The cover 40 is secured to the slip on flange 18 of the lower leg 14 of the outer shell 10 by one or more bolts 42 or other securements members.

The cover 40 includes an opening 58 through which a gas line can be connected to the gas delivery tube 26 of the catalyst insert, e.g. via the tube bulkhead 29.

In accordance with one or more preferred implementations, a safety shutoff mechanism is provided which is configured to automatically shut off the flow of gas if the temperature drops below a certain level (e.g. three hundred degrees or two hundred and ninety five degrees).

FIG. 8 illustrates an exemplary safety shutoff apparatus 50 implementing such a safety shutoff mechanism, but it will be appreciated that various different implementations may be utilized. The exemplary safety shutoff apparatus 50 illustrated in FIG. 8 is configured for connection of gas input and output lines for passing a gas line therethrough. In particular, the safety shutoff apparatus 50 includes an input gas line connector 52 and a corresponding output gas line connector. The exemplary safety shutoff apparatus 50 is configured to control the flow of gas based on monitoring of temperature.

The safety shutoff apparatus 50 includes a temperature sensor, which may comprise a simple thermocouple, or may comprise a more complex sensor. The cover 40 includes an opening 57 through which such a temperature sensor, and a wire 56 connecting it to the safety shutoff apparatus 50, may pass.

In accordance with one or more preferred implementations, a mechanical safety shutoff process is provided where a thermocouple is utilized to monitor temperature and automatically effect closure of a safety shutoff valve in the event of a temperature drop.

In accordance with one or more preferred implementations, an initiation switch or button is utilized to facilitate operation initiation. In accordance with one or more preferred implementations, an initiation switch is configured to trigger provision of power to and current flow through a resistive heating element thereby heating a catalyst element. Once a sensor (such as a thermocouple or other sensor) senses that a certain temperature is reached at the catalyst element, a gas valve will be opened and gas will be supplied through the gas delivery tube to the catalyst element to sustain a catalytic reaction, and power will be cut to the resistive heating element. Preferably, if it is subsequently determined that the temperature has dropped, then gas will no longer be supplied, as noted hereinabove with respect to disclosure of a safety shutoff mechanism, and the button or switch will release (e.g. no longer be depressed), and be ready for activation again.

In the implementation described hereinabove with reference to FIG. 5, an initiation button triggers provision of power to and current flow through the exposed, coiled nickel chromium wire segment 31, thereby heating the catalyst element 22.

The exemplary safety shutoff apparatus 50 illustrated in FIG. 8 includes an initiation button 54, although it will be appreciated that an initiation switch may be implemented in various ways, either as its own component or as part of another component.

In accordance with one or more preferred implementations, one or more manual controls are provided to allow a user to control the flow of gas. Preferably, these include a mechanism for increasing or decreasing the flow of gas through a gas delivery tube.

The exemplary safety shutoff apparatus 50 illustrated in FIG. 8 includes a manual control 53 configured to allow a user to increase or decrease the flow of gas through the gas delivery tube 26, although it will be appreciated that such a manual control may be implemented in various ways, either as its own component or as part of another component.

The cover 40 further includes an opening 43 corresponding to the opening 36 of the front cap 32 for ends of or one or more electrical connectors 28,29 for the nickel chromium wire. The cover 40 may include a connection box such as the exemplary connection box 60 illustrated in FIG. 8. FIG. 8 depicts electrical connectors 28,29 for a heating element as connecting to connectors on the cover 40, although other configurations may be utilized in other implementations. Similarly, although FIG. 8 depicts wires being connected together in a paired wire that runs to an electrical connector 64, other configurations may be utilized in other implementations.

Preferably, provision of electrical power is tied to temperature monitoring, such that power is automatically cut once a sufficient temperature (e.g. three hundred degrees Fahrenheit) is reached with allows a self-sustaining catalytic reaction to occur. In accordance with one or more preferred implementations, a simple mechanical thermocouple is utilized for temperature monitoring and to trigger cutting of power, although in one or more preferred implementations, a more complex sensor may be utilized.

FIG. 8 provides a fanciful, exemplary depiction with a wire running from the safety shutoff apparatus 50 to the connection box 60 that controls provision of power to the resistive heating element (e.g. the nickel chromium wire). In one or more preferred implementations, power may run directly through such a safety shutoff apparatus, e.g. the safety shutoff apparatus may have electrical in and out connectors. In one or more preferred implementations, an alternative architecture may be utilized to control the flow of power based on a temperature sensor (such as a basic thermocouple or a more complex sensor).

The cover 40 further includes one or more airflow openings 44 configured to provide air to the interior of the outer shell 10 so as to sustain a catalytic reaction once it is ongoing.

It will be appreciated that innovative features and functionality described hereinabove in the context of a particular design can be implemented in various other designs as well.

Figure 9:
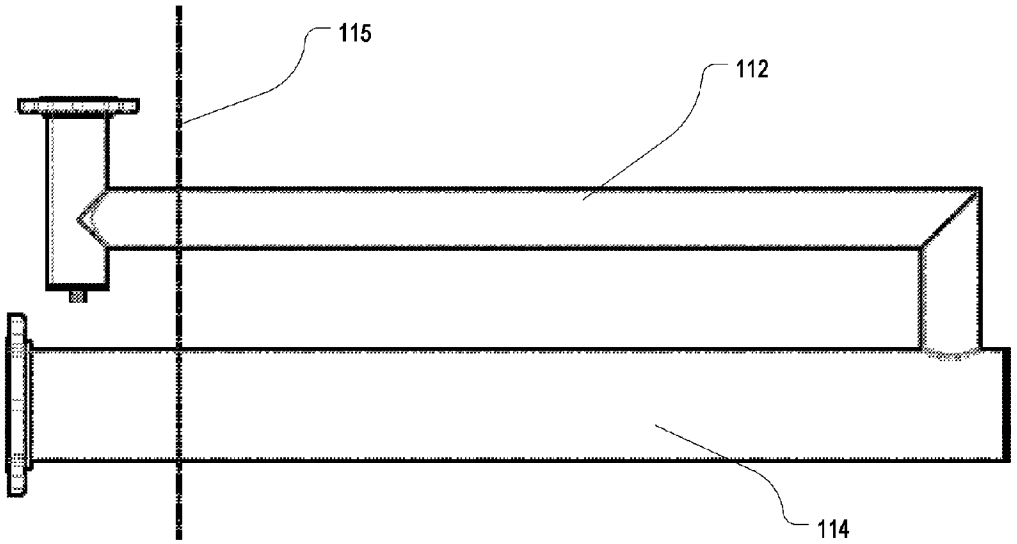
FIG. 9 illustrates an exemplary, alternative design for an outer shell in accordance with one or more preferred implementations.
Figure 10:
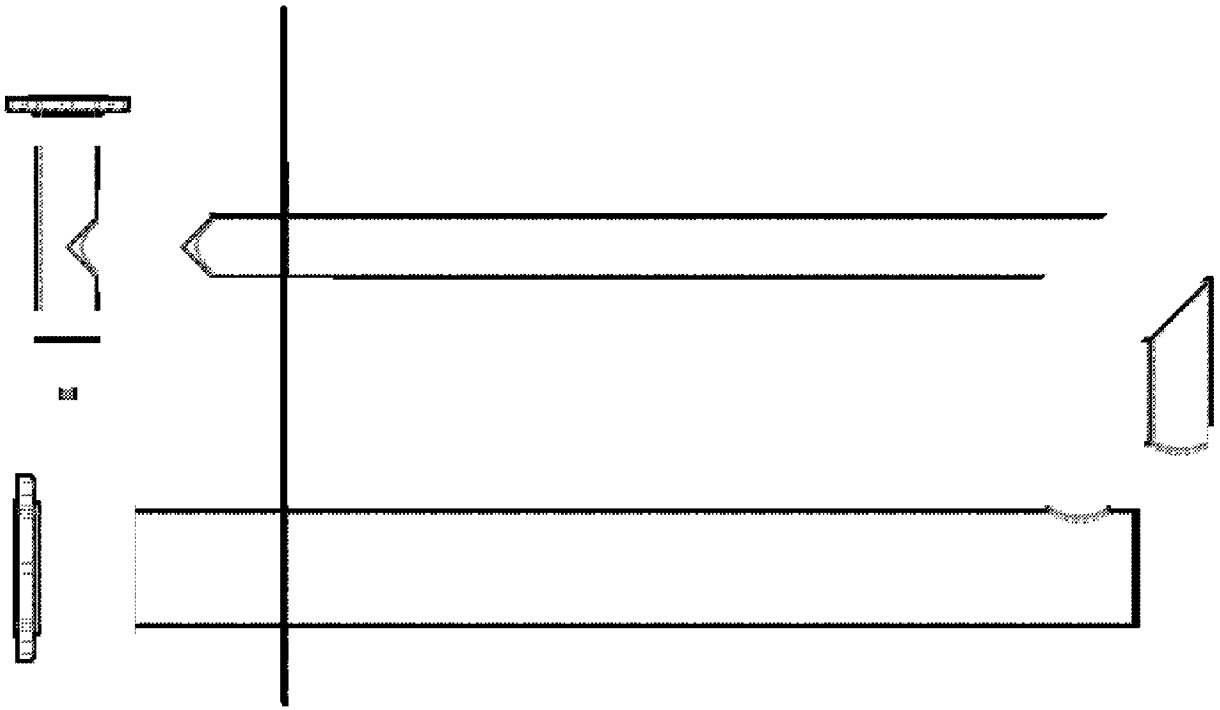
FIG. 10 illustrates pieces which can be welded together to form the outer shell of FIG. 9.
Figure 11:
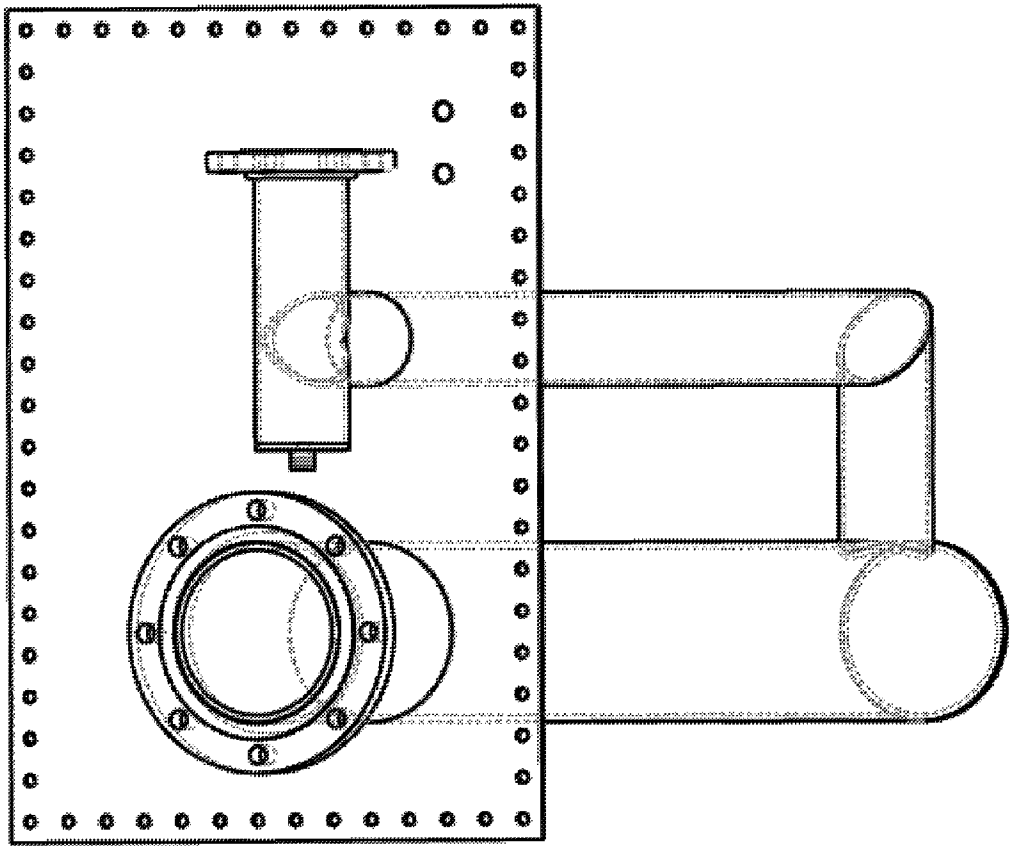
FIGS. 11 and 12 provide additional different schematic views of the outer shell of FIG. 9.
Figure 12:
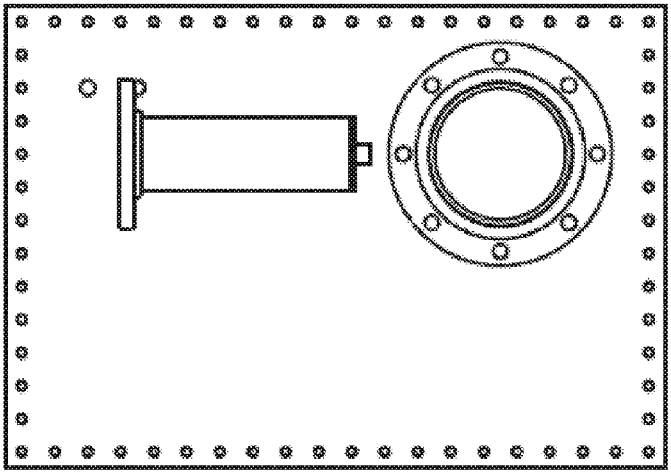

For example, FIG. 9 illustrates an exemplary, alternative design for an outer shell 110 in accordance with one or more preferred implementations. The outer shell 110 of FIG. 9 is configured to be welded together from a multitude of smaller pieces, which are illustrated in FIG. 10. As with the outer shell 10, the outer shell 110 comprises upper and lower tubular legs 112,114 which pass through, and are welded to, a manway cover 115. FIGS. 11 and 12 provide additional different schematic views of the outer shell 110.

Figure 13:
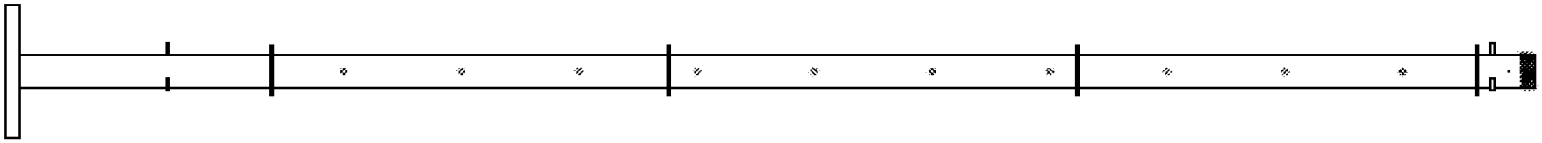
FIG. 13 illustrates an exemplary, alternative design for a catalyst insert.
Figure 14:
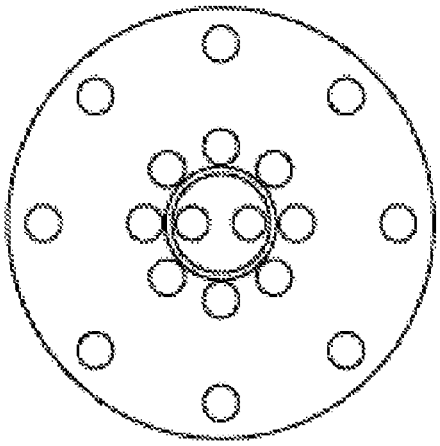
FIG. 14 is an end-on view of the catalyst insert of FIG. 13.

Similarly, FIG. 13 illustrates an exemplary, alternative design for a catalyst insert which utilizes a two inch schedule 40 pipe with openings therethrough on the sides and top. In one or more preferred implementations, the openings include four sets of openings spaced ninety degrees apart from one another along the circumference of the pipe, in particular at the top, bottom, and two sides of the pipe. Each set of openings includes openings spaced along the length of the pipe, e.g. spaced every eight inches along the length of the pipe. In one or more preferred implementations, the openings on the top and bottom are offset laterally from the openings on the sides. The insert includes a catalyst suspended on the outside of the pipe. The insert further includes one or more generally circular rings secured around the outside of the pipe. The insert still further includes one or more sets of two or three projections secured to the outside of the insert for facilitating orientation of the insert within an outer shell. In accordance with one or more preferred implementations, the insert might include a flange integrally connected thereto, as illustrated in FIG. 13. FIG. 14 is an end-on view illustrating the flange.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A system for heating a vessel comprising:

(a) a tank containing a fluid to be heated;

(b) an outer shell configured to be enclosed by the tank comprising (i) a tubular upper leg, (ii) a tubular lower leg disposed adjacent to the tubular upper leg, (iii) wherein the tubular lower leg is in fluid connection with the tubular upper leg proximate a first end of the tubular lower leg, (iv) wherein the tubular lower leg comprises an access opening at a second end of the tubular lower leg providing access to an interior thereto;

(c) a catalyst insert disposed within the interior of the tubular lower leg, the catalyst insert comprising (i) a central gas delivery tube comprising a plurality of openings disposed along its length for the outflow of gas from the gas delivery tube, (ii) a generally cylindrical perforated core surrounding the central gas delivery tube, the perforated core comprising a plurality of openings for facilitating flow of gas through the perforated core, (iii) refractory insulation wrapped around the outside of the perforated core, (iv) a heating element comprising a wire including (A) a non-insulated segment of wire coiled around the outside of the refractory insulation generally down the entire length of the catalyst insert, and (B) an insulated segment of wire running generally back up along the entire length of the catalyst insert, (v) a catalyst element wrapped around the refractory insulation such that the coiled wire is disposed between the refractory insulation and the catalyst element, the catalyst element being configured to facilitate a catalytic reaction, (vi) front and end caps configured to secure components of the catalyst insert, the front cap comprising (A) an opening for the central gas delivery tube, and (B) an opening for one or more electrical connectors for the heating element;

(d) a vent apparatus connected to the tubular upper leg for venting gas byproducts of the catalytic reaction facilitated by the catalyst element;

(e) a temperature sensor configured to monitor a temperature proximate the catalyst element;

(f) a cover configured to generally cover the access opening of the tubular lower leg, the cover comprising (i) a gas line opening having a gas line passing therethrough that is connected to the central gas delivery tube of the catalyst insert, (ii) a sensor opening having a connecting wire for the temperature sensor passing therethrough, (iii) one or more electrical openings having one or more electrical connectors for the heating element of the catalyst insert passing therethrough, (iv) one or more airflow openings configured to provide air to sustain a catalytic reaction;

(g) an automatic shutoff valve configured to cease the flow of gas through the gas line based on the temperature sensor if a temperature drops below a first predetermined threshold;

(h) an initiation button configured to initiate a pre-heating process comprising (i) providing power to the heating element, (ii) automatically, based on a determination by the temperature sensor that a temperature proximate the catalyst element exceeds a second predetermined threshold, (A) terminating the provision of power to the heating element, and (B) opening the automatic shutoff valve allowing for the flow of gas through the gas line.

2. The system of claim 1, wherein the gas line provides natural gas.

3. The system of claim 1, wherein the temperature sensor comprises a thermocouple.

4. The system of claim 1, wherein the catalyst element is configured to facilitate a catalytic reaction utilizing air and natural gas which generates byproducts of water, carbon dioxide, and heat.

5. The system of claim 1, wherein the catalyst element comprises an alumina-silica pad washed with elemental platinum to act as a hydrocarbon catalyst.

6. The system of claim 1, wherein the refractory insulation comprises an alumina-silica pad.

7. The system of claim 1, wherein the first and second predetermined thresholds are the same.

8. The system of claim 1, wherein the temperature sensor is a mechanical sensor.

9. The system of claim 1, wherein the temperature sensor is a digital sensor.

10. The system of claim 1, wherein the first and second predetermined thresholds are different.

11. The system of claim 1, wherein the first predetermined threshold is around three hundred degrees Fahrenheit.

12. A method for heating a vessel, the method involving (a) a tank containing a fluid to be heated;

(b) an outer shell configured to be enclosed by the tank comprising (i) a tubular upper leg, (ii) a tubular lower leg disposed adjacent to the tubular upper leg, (iii) wherein the tubular lower leg is in fluid connection with the tubular upper leg proximate a first end of the tubular lower leg, (iv) wherein the tubular lower leg comprises an access opening at a second end of the tubular lower leg providing access to an interior thereto;

(c) a catalyst insert disposed within the interior of the tubular lower leg, the catalyst insert comprising (i) a central gas delivery tube comprising a plurality of openings disposed along its length for the outflow of gas from the gas delivery tube, (ii) a generally cylindrical perforated core surrounding the central gas delivery tube, the perforated core comprising a plurality of openings for facilitating flow of gas through the perforated core, (iii) refractory insulation wrapped around the outside of the perforated core, (iv) a heating element comprising a wire including (A) a non-insulated segment of wire coiled around the outside of the refractory insulation generally down the entire length of the catalyst insert, and (B) an insulated segment of wire running generally back up along the entire length of the catalyst insert, (v) a catalyst element wrapped around the refractory insulation such that the coiled wire is disposed between the refractory insulation and the catalyst element, the catalyst element being configured to facilitate a catalytic reaction, (vi) front and end caps configured to secure components of the catalyst insert, the front cap comprising (A) an opening for the central gas delivery tube, and (B) an opening for one or more electrical connectors for the heating element;

(d) a vent apparatus connected to the tubular upper leg for venting gas byproducts of the catalytic reaction facilitated by the catalyst element;

(e) a temperature sensor configured to monitor a temperature proximate the catalyst element;

(f) a cover configured to generally cover the access opening of the tubular lower leg, the cover comprising (i) a gas line opening having a gas line passing therethrough that is connected to the central gas delivery tube of the catalyst insert, (ii) a sensor opening having a connecting wire for the temperature sensor passing therethrough, (iii) one or more electrical openings having one or more electrical connectors for the heating element of the catalyst insert passing therethrough, (iv) one or more airflow openings configured to provide air to sustain a catalytic reaction;

(g) an automatic shutoff valve configured to cease the flow of gas through the gas line based on the temperature sensor if a temperature drops below a first predetermined threshold; and (h) an initiation button configured to initiate a pre-heating process;

wherein the method comprises, in response to pressing of the initiation button by a user, (I) providing power to the heating element, (II) automatically, based on a determination by the temperature sensor that a temperature proximate the catalyst element exceeds a second predetermined threshold, (a) terminating the provision of power to the heating element, and (b) opening the automatic shutoff valve allowing for the flow of gas through the gas line.

13. The system of claim 12, wherein the temperature sensor comprises a thermocouple.

14. The system of claim 12, wherein the catalyst element is configured to facilitate a catalytic reaction utilizing air and natural gas which generates byproducts of water, carbon dioxide, and heat.

15. The system of claim 12, wherein the catalyst element comprises an alumina-silica pad washed with elemental platinum to act as a hydrocarbon catalyst.

16. The system of claim 12, wherein the first and second predetermined thresholds are the same.

17. The system of claim 12, wherein the temperature sensor is a mechanical sensor.

18. The system of claim 12, wherein the temperature sensor is a digital sensor.

19. The system of claim 12, wherein the first and second predetermined thresholds are different.

20. A method for heating a vessel, the method involving (a) a tank containing a fluid to be heated;

(b) an outer shell configured to be enclosed by the tank comprising (i) a tubular upper leg, (ii) a tubular lower leg disposed adjacent to the tubular upper leg, (iii) wherein the tubular lower leg is in fluid connection with the tubular upper leg proximate a first end of the tubular lower leg, (iv) wherein the tubular lower leg comprises an access opening at a second end of the tubular lower leg providing access to an interior thereto;

(c) a catalyst insert disposed within the interior of the tubular lower leg, the catalyst insert comprising (i) a central gas delivery tube comprising a plurality of openings disposed along its length for the outflow of gas from the gas delivery tube, (ii) a generally cylindrical perforated core surrounding the central gas delivery tube, the perforated core comprising a plurality of openings for facilitating flow of gas through the perforated core, (iii) refractory insulation wrapped around the outside of the perforated core, (iv) a heating element comprising a wire including (A) a non-insulated segment of wire coiled around the outside of the refractory insulation generally down the entire length of the catalyst insert, and (B) an insulated segment of wire running generally back up along the entire length of the catalyst insert, (v) a catalyst element wrapped around the refractory insulation such that the coiled wire is disposed between the refractory insulation and the catalyst element, the catalyst element being configured to facilitate a catalytic reaction, (vi) front and end caps configured to secure components of the catalyst insert, the front cap comprising (A) an opening for the central gas delivery tube, and (B) an opening for one or more electrical connectors for the heating element;

(d) a vent apparatus connected to the tubular upper leg for venting gas byproducts of the catalytic reaction facilitated by the catalyst element;

(e) a temperature sensor configured to monitor a temperature proximate the catalyst element;

(f) a cover configured to generally cover the access opening of the tubular lower leg, the cover comprising (i) a gas line opening having a gas line passing therethrough that is connected to the central gas delivery tube of the catalyst insert, (ii) a sensor opening having a connecting wire for the temperature sensor passing therethrough, (iii) one or more electrical openings having one or more electrical connectors for the heating element of the catalyst insert passing therethrough, (iv) one or more airflow openings configured to provide air to sustain a catalytic reaction;

(g) an automatic shutoff valve; and (h) an initiation button configured to initiate a pre-heating process;

wherein the method comprises, when gas is flowing through the gas line to the gas delivery tube of the catalyst insert, in response to a determination by the temperature sensor that a temperature proximate the catalyst element has dropped below a first predetermined threshold, automatically closing the automatic shutoff valve to stop flow of the gas to the gas delivery tube of the catalyst element.

* * * * *